United States Patent [19]

Perlmutter

[11] 4,037,719

[45] July 26, 1977

[54] CIGARETTE COUNTING CASE

[76] Inventor: Alan Perlmutter, 120 Pitt Road, Springfield, N.J. 07081

[21] Appl. No.: 691,559

[22] Filed: June 1, 1976

[51] Int. Cl.[2] ..... B65D 85/10

[52] U.S. Cl. ..... 206/266; 116/129 S; 116/133; 131/170 A; 206/236; 206/459; 221/7; 235/1 C

[58] Field of Search ..... 116/73, 120, 129 S, 116/133; 235/91 R, 104 B, 91 B, 1 C, 114; 131/8 R, 170 R, 170 A, 178; 206/265, 266, 268, 242, 236, 38, 459, 86, 534; 221/2, 7, 8

[56] References Cited

U.S. PATENT DOCUMENTS

| | | | |
|---|---|---|---|
| 1,985,652 | 12/1934 | Campbell | 116/120 |
| 2,148,319 | 2/1939 | Negbaur | 206/259 |
| 2,618,956 | 11/1952 | Hanna | 206/266 |
| 2,658,468 | 11/1953 | Enfield | 206/266 |
| 3,017,763 | 1/1962 | Weil | 206/236 |
| 3,298,590 | 1/1967 | Gray | 206/268 |
| 3,424,123 | 1/1969 | Giffard | 206/236 |
| 3,493,172 | 2/1970 | Bromage | 116/133 |
| 3,660,998 | 5/1972 | Ishijima | 131/170 A |
| 3,735,099 | 5/1973 | Herr | 235/91 R |
| 3,850,134 | 11/1974 | Colasuono | 116/133 |
| 3,861,523 | 1/1975 | Fountain et al. | 131/170 A |

*Primary Examiner*—George E. Lowrance
*Assistant Examiner*—Bruce H. Bernstein
*Attorney, Agent, or Firm*—Richard L. Miller

[57] ABSTRACT

A case for containing a pack of cigarettes, the case including a counting mechanism which counts the number of times that the case is opened up so to remove a cigarette from the pack, thus enabling a smoker, who wished to cut down on his smoking habit, to keep track of the number of cigarettes being smoked during a current day, the counting mechanism also having a counter that records the number of cigarettes smoked on a previous day for purposes of comparison.

1 Claim, 3 Drawing Figures

CIGARETTE COUNTING CASE

This invention relates generally to cigarette cases such as may be carried on a person and which contain a pack of cigarettes.

It is well known that numerous cigarette smokers are presently trying hard to break their habit of cigarette smoking particularly in view of the recent decision of the government surgeon-general that cigarette smoking may be harmful to a person's health. Numerous medical authorities have proved that there is a greater incidence of lung and throat cancer among smokers than among non-smokers. Furthermore, the habit is costly to support particularly when a person is a heavy smoker. Thus numerous methods are currently being tried by smokers to stop or at least decrease the smoking habit.

Therefore it is a principal object of the present invention to provide a cigarette case which promotes the awareness of the number of cigarettes that a person smokes in order that he tries in future to decrease this number.

Another object is to provide a cigarette case which automatically records each time that the cigarette case is opened up so to remove a cigarette therefrom.

Still another object is to provide a cigarette counting case which additionally can record the number of cigarettes smoked on a previous day so that a smoker can currently improve on this figure by smoking less.

Further objects of the invention will appear as the description proceeds.

To the accomplishment of the above and related objects, this invention may be embodied in the form illustrated in he accompanying drawings, attention being called to the fact, however, that the drawings are illustrative only, and that changes may be made in the specific construction illustrated and described within the scope of the appended claims.

Figure 1:
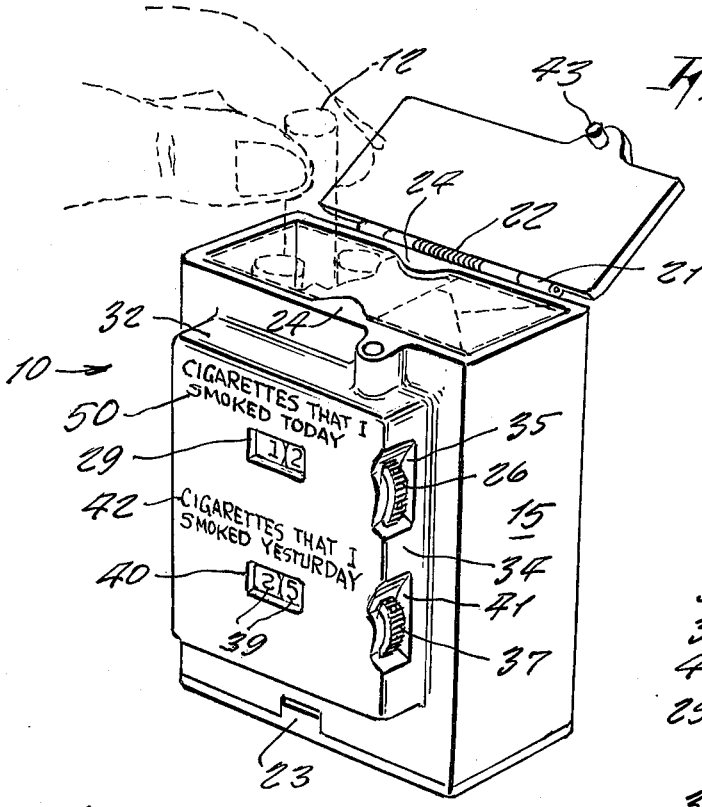
FIG. 1 is a perspective view of the invention
Figure 2:
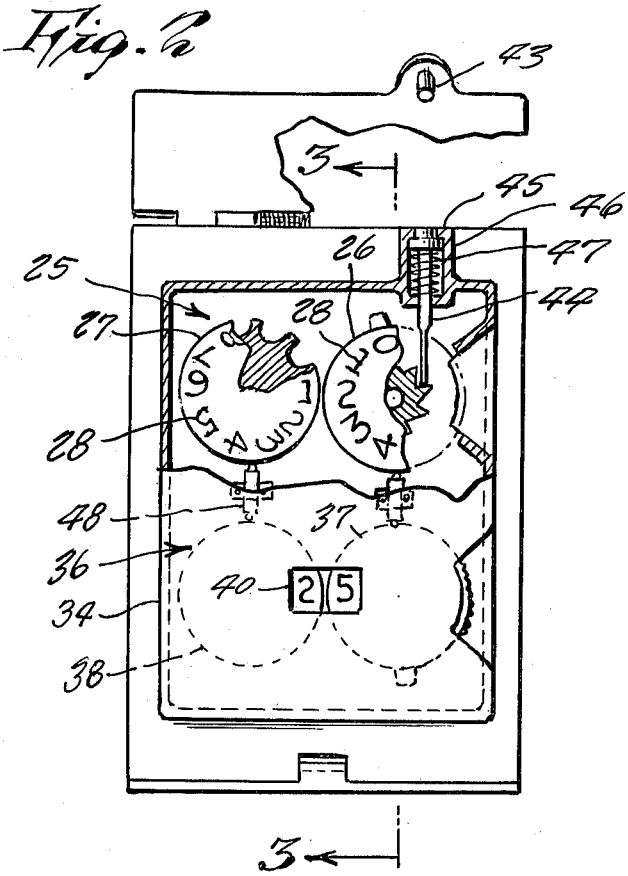
FIG. 2 is a front view thereof shown partly broken away so to illustrate the interior thereof.
Figure 3:
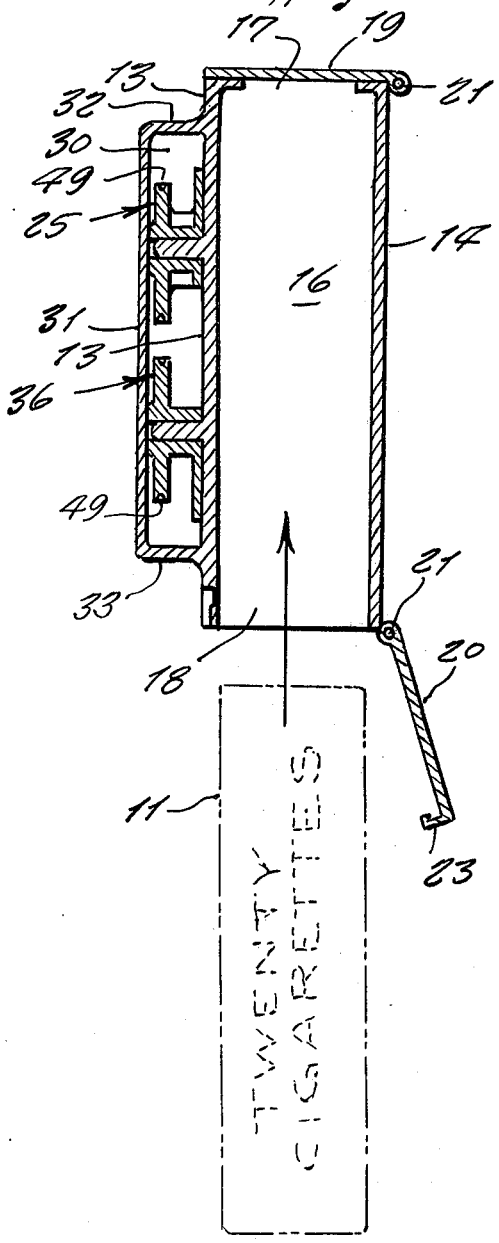
FIG. 3 is a cross-section on line 3—3 of FIG. 2.

Referring now to the drawing in detail, the reference numeral 10 represents a cigarette counting case wherein the same is of a size so that a conventional pack 11 of cigarettes 12 can be readily fitted thereinto.

The case 10, made preferably of molded hard plastic, thus consists of a front wall 13, rear wall 14 and opposite side walls 15 around a central compartment 16 having an opening 17 at its upper end and an opening 18 at its lower end each of which is closable by a door 19 and 20 respectively pivotable about hinges 21 having a coil spring 22 so to hold the door in a normally closed position. The bottom door additionally includes a latch 23 as this door is opened less frequently, and only at such time that a fresh cigarette pack 11 is needed to refill the case, whereas the top cover can be easily flipped open each time that a cigarette is removed from the pack.

Accordingly, the pack 11 is inserted into the case through the bottom opening 18, the upper end of the pack being torn open so that access to the individual cigarettes is thus possible through the top opening 17.

The pack is prevented from being inserted into the case through the top opening 17 by means of a pair of tabs 24 that block the opening, so that the top door is thus not opened up when the case is being reloaded with a new pack, thereby not effecting a counting mechanism 25 that is operated by the top door so to count each time that the top door is opened up so to remove a cigarette.

The counting mechanism 25 is of conventional type having wheels 26 and 27 with numerical digits 28 imprinted thereupon so to be moved behind a window 29 so to see a numerical total. The mechanism 25 is located inside a compartment 30 formed between case front wall 13 and a wall 31 located in front thereof and being integrally enjoined therewith by narrow top, bottom and side wals 32, 33 and 34 respectively. The completely molded case is maintained sufficiently thin so it will fit in a person's pocket or purse. A notch 35 on a side wall 34 allows manual re-adjustment of the mechanism by rotating, with a finger a knurlled edge of one of the wheels 26 protruding outwardly through the side wall and into the notch.

Another mechanism 36 inside the compartment 30 includes wheels 37 and 38 having numerical digits 39 for selective alignment behind window 40 of front wall 31. Another notch 41 on side wall 34 allows manual adjustment of the mechanism 36. A text 42 is imprinted adjacent window 40, and in use, he mechanism 36 is adjusted so that a numerical total is shown in window 40 indicating the number of cigarettes that were smoked on a previous day.

The mechanism 25, in operative use, is pre-set at a start of each day so a zero is shown in window 29.

The mechanism 25 is automatically operated each time that the top door is closed, after a cigarette is removed, as shown in FIG. 1. A short post 43 on the underside of the top door pushes downward a pin 44 against the wheel 26 so to advance the mechanism one digit ahead. Pin 44 has an upper end that is flush with a top wall 45 of a sleeve 46 integially molded on the case so it cannot be accidently pushed down. A compression coil spring 47 inside the sleeve normally maintains the pin in a raised position.

Both mechanisms 25 and 26 employ detents 48 to prevent the wheels from accidently slipping rotationally and disaligning numerical readings in the observation windows the detents engaging notches 49 around the wheels.

A text 50 near the window 29 indicates a number of cigarettes smoked on a current day.

Thus a novel cigarette counting case is provided.

While certain novel features of this invention have been shown and described and are pointed out in he annexed claims, it will be understood that various omissions, substitutions and changes in the forms and details of the device illustrated and in its operation can be made by those skilled in the art without departing from the spirit of the invention.

I claim:

1. In a cigarette counting case, the combination of a first housing for containing a pack of cigarettes, a compartment in said first housing having a top opening and a bottom opening, said top opening being normally retained closed by an upwardly pivotable, spring-loaded top door, and said bottom opening being normally retained closed by a downwardly pivotable, spring-loaded bottom door, and said top door having a downwardly protruding post on its underside activating a counting mechanism contained in a second housing integrally formed on a front side of said first housing; said top opening including a pair of inwardly projecting tabs along a center of opposite longitudinal side edges thereof to prevent passage of a cigarette pack through said top opening into or out of said first housing thereby requiring usage of only said bottom opening for entering and removing a cigarette pack into said first housing, said second housing containing also a second counting mechanism that is manually operated; said mechanims each including a pair of intermeshing, numerically calibrated wheels behind a window opening on said second housing exposing aligned numerical calibrations of said pair of wheels, one said wheel having a knurled edge extending in a notch on an outer side of said second housing for manual resetting of said pair of wheels; said first mechanism being indicated with a text "cigarettes that I smoked today" and said second mechanism being indicated with a text "cigarettes that I smoked yesterday;" and said first mechanism, activated by said post, including a spring-loaded plunger pin which at its lower end bears against ratchet teeth of said knurl-edged wheel, said pin being slidable in a hole which opens on a top edge of said first housing, said pin at rest having an upper end that is flush with said first housing top edge.

* * * * *